US005418128A

United States Patent [19]

Orem

[11] Patent Number: 5,418,128

[45] Date of Patent: May 23, 1995

[54] PHOTOGRAPHIC ELEMENT AND COATING COMPOSITION THEREFOR

[75] Inventor: Michael W. Orem, Rochester, N.Y.

[73] Assignee: Eastman Kodak Company, Rochester, N.Y.

[21] Appl. No.: 220,850

[22] Filed: Mar. 31, 1994

[51] Int. Cl.[6] ..... G03C 1/38

[52] U.S. Cl. ..... 430/631; 430/637; 430/642

[58] Field of Search ..... 430/631, 637, 642

[56] References Cited

U.S. PATENT DOCUMENTS

| | | |
|---|---|---|
| 3,762,928 | 10/1973 | Willems . |
| 3,775,126 | 11/1973 | Babbitt et al. . |
| 3,850,640 | 11/1974 | Babbitt et al. . |
| 3,884,699 | 5/1975 | Cavallo et al. . |
| 4,013,696 | 3/1977 | Babbitt et al. . |
| 4,267,265 | 5/1981 | Sugimoto et al. . |
| 4,367,283 | 1/1983 | Nakayama et al. . |
| 4,547,459 | 10/1985 | Kamio et al. . |
| 4,596,766 | 6/1986 | Nemori et al. . |
| 4,847,186 | 7/1989 | Mukunoki et al. . |
| 4,891,307 | 1/1990 | Mukunoki et al. . |
| 4,916,054 | 4/1990 | Yoneyama et al. . |
| 4,956,270 | 9/1990 | Tachibana et al. . |
| 4,968,599 | 11/1990 | Pitt et al. . |
| 5,028,516 | 7/1991 | Mukunoki et al. . |
| 5,288,598 | 2/1994 | Sterman et al. . |

FOREIGN PATENT DOCUMENTS

| | | |
|---|---|---|
| 61-42654 | 8/1984 | Japan . |
| 63-25648 | 7/1986 | Japan . |
| 4-277736 | 2/1992 | Japan . |
| 2096782 | 10/1982 | United Kingdom . |

OTHER PUBLICATIONS

Disclosed Anonymously (R1278), *Research Disclosure 10147*, Sep. 1972.

*Primary Examiner*—Thorl Chea
*Attorney, Agent, or Firm*—Robert A. Gerlach

[57] ABSTRACT

A coating composition for applying a layer to a photographic element which comprises gelatin, water and from 0.35 to 1 percent by weight based on the total weight of the composition of a surfactant mixture comprising from 20 to 60 percent by weight of a mixture of anionic surfactants, from 30 to 75 percent by weight of a nonionic surfactant and from 3 to 13 percent by weight of a cationic surfactant based on the total weight of surfactant mixture; the mixture of anionic surfactants comprising from 30 to 85 percent by weight of di- and tri-isopropyl naphthalene sulfonate, sodium salts and from 15 to 70 percent by weight of a dioctyl sulfosuccinate, sodium salt; a di-fluoroalkyl sulfosuccinate, sodium salt where alkyl is $C_4$–$C_6$; perfluoro-octyl sulfonate(tetraethyl ammonium salt) or a perfluoro-alkyl carboxylate ammonium salt where alkyl is a mixture of $C_5$–$C_8$ alkyl radicals with hexyl being the major component, based on the total weight of the anionic surfactants; the nonionic surfactant being a nonyl phenoxy poly(glycidyl) alcohol and the cationic surfactant being perfluoro-octyl sulfonamide, N-hydrogen, N-propylene trimethylammonium iodide.

10 Claims, No Drawings

PHOTOGRAPHIC ELEMENT AND COATING COMPOSITION THEREFOR

FIELD OF THE INVENTION

This invention relates to a mixture of surfactants and more particularly to photographic elements having an overcoat layer and adjacent layers with a high degree of uniformity in layer thickness incorporating the surfactant mixture.

BACKGROUND OF THE INVENTION

In order to manufacture multilayer photographic film materials of high quality and low cost, it is required that several layers be coated simultaneously at high coating speeds, and that the individual layers have a high degree of thickness uniformity including the absence of spot nonuniformities. Overcoat layers of photographic film products often contain a variety of dispersed addenda such as polymer matte beads and lubricant materials. Some of these may increase the propensity for the formation of round or comet-shaped spot nonuniformities (in thickness of the overcoat and adjacent layers) of the type called repellency spots. These repellency spots formby surface-tension driven flow in small areas during the coating process and have dimensions large enough to be seen without magnification or with up to 10×magnification. Surface active compounds or surfactants are added to the coating solutions of overcoat layers to prevent the formation of undesired layer thickness nonuniformities including repellency spots. When added for this purpose, they are called "coating aids".

Many surfactant compounds with a variety of chemical structures have been used as coating aids for improved layer thickness uniformity in manufacturing photographic materials. It is known that surfactant coating aids with different chemical structures exhibit different degrees of effectiveness in controlling repellency spots. Since the surfactants present in overcoat layers can also have a significant influence on surface physical properties of the multilayer photographic material after drying, mixtures of one or more coating aid surfactants with one or more other surfactants are commonly used in overcoat layers for the purpose of modifying physical properties. Although there are several surfactant mixtures widely used as coating aids for overcoat layers, there is a need for improved coating aid mixtures for improved control of repellency spots. This is especially true in the case of overcoat layers which contain alkali-soluble polymer matte beads, specifically poly(methyl methacrylatemethacrylic acid) copolymer matte compositions. The surfactant mixtures must simultaneously provide the required surface physical properties needed for each specific type of film product.

SUMMARY OF THE INVENTION

The invention provides photographic elements and coating compositions for applying layers to a photographic element which comprises gelatin, water and from 0.35 to 1 gm/100 gms of the coating composition of a surfactant mixture comprising from 20 to 60 percent by weight of an anionic surfactant mixture, the anionic surfactant mixture being present in an amount of at least 0.15 gm/100 gms of coating composition, from 30 to 75 percent by weight of a nonionic surfactant and from 3 to 13 percent by weight of a cationic surfactant based on the total weight of surfactant mixture; the mixture of anionic surfactants comprising from 30 to 85 percent by weight of di- and tri-isopropyl naphthalene sulfonate, sodium salts and from 15 to 70 percent by weight of a dioctyl sulfosuccinate, sodium salt; a di-fluoroalkyl ($C_4$–$C_6$) sulfosuccinate, sodium salt; perfluoro-octyl sulfonate(tetraethyl ammonium salt) or a perfluoro-alkyl carboxylate ammonium salt where alkyl is a mixture of $C_5$–$C_8$ alkyl groups with hexyl being the major component, based on the total weight of the anionic surfactants; the nonionic surfactant being a nonyl phenoxy poly(glycidyl) alcohol and the cationic surfactant being perfluoro-octyl sulfonamide, N-hydrogen, N-propylene trimethylammonium iodide.

The layers in accordance with the above are advantageous in that they have reduced propensities for spot nonuniformities in layer thickness, i.e., they have fewer repellency spots. This is true especially when the layers, such as, overcoat layers contain alkali-soluble polymer matte beads particularly soluble polymeric matte beads of poly(methylmethacrylatemethacrylic acid) composition. By alkali-soluble matte beads is meant, matte beads that are soluble in the processing solutions utilized in the development of photographic films. Methylmethacrylate methacrylic acid copolymer matte beads are widely used in the photographic industry.

DETAILED DESCRIPTION OF THE INVENTION

In the surfactant mixture in accordance with this invention, the anionic surfactant must be present in an amount of at least 0.15 gm/100 gms of the coating composition, preferably in an amount of at least 0.2 gm/100 gm and must contain at least two different anionic surfactants, with from 30 to 85 percent by weight preferably 40 to 80 percent by weight of the anionic surfactants being di- and tri-isopropyl naphthalene sulfonate, sodium salt. The remainder of the anionic surfactant is one or more of the mentioned anionic surfactants. The anionic surfactant mixture is present in the coating composition in an amount of 20 to 60 percent by weight.

The di- and tri-isopropyl naphthalene sulfonate, sodium salt is preferably a surfactant sold under the trade designation Alkanol XC by DuPont Co.

In the mixture of anionic surfactants, any suitable dioctyl sulfosuccinate, sodium salt may be employed such as, for example, di-n-octyl sulfosuccinate, sodium salt; di-2- methylheptyl sulfosuccinate, sodium salt; di-2,2-dimethylhexyl sulfosuccinate, sodium salt; di-2-propylpentyl sulfosuccinate, sodium salt; di-2-ethylhexyl sulfosuccinate, sodium salt; di-2,2,3-trimethylpentyl sulfosuccinate, sodium salt; di-3-methyl-4-ethylpentyl sulfosuccinate, sodium salt; mixtures thereof and the like. Di-2-ethylhexyl sulfosuccinate, sodium salt is preferred.

In the mixture of anionic surfactants, any suitable di-fluoroalkyl ($C_4$–$C_6$) sulfosuccinate, sodium salt may be used such as, for example, compounds having fluoroalkyl groups where the alkyl portion contains from 4 to 6 carbon atoms and at least 5 hydrogen atoms at the end of each alkyl group are substituted with fluorine atoms. Examples of such compounds include: di-2,2,3,3,4,4,4-heptafluorobutyl sulfosuccinate, sodium salt; di-3,3,4,4,5,5,5-heptafluoroamyl sulfosuccinate, sodium salt; di-4,4,5,5,6,6,6heptafluorohexyl sulfosuccinate, sodium salt; mixtures thereof; and the like.

As the perfluoro-octyl sulfonate (tetraethyl ammonium salt), any suitable compound may be used where the octyl group may, be n-octyl, 2-methyl heptyl, 2-ethyl hexyl, 2,3,-dimethyl hexyl, 2,2 -dimethyl hexyl, mixtures thereof and the like.

The perfluoro-alkyl carboxylate ammonium salt is a mixture of such compounds where the alkyl groups range from $C_5$–$C_8$ with the major component being hexyl. Suitable alkyl radicals include n-pentyl, isopentyl, neopentyl, n-hexyl, isohexyl, 2,2-dimethyl butyl, n-heptyl isohexyl, 2,2-dimethyl pentyl, n-octyl, 2-methyl heptyl, 2-ethyl hexyl, mixtures thereof and the like.

The nonionic surfactant is a nonyl phenoxy polyglycidyl alcohol which is represented by the following formula:

$$C_9H_{19}-C_6H_4-O-(CH_2\underset{\underset{OH}{|}}{C}HCH_2O)_n-H$$

where n represents values of from 6 to 12 with a mean value of 8 to 9 The nonyl phenoxy polyglycidyl alcohol is employed in the surfactant mixture in an amount of from 30 to 75 percent by weight and preferably from 40 to 60 percent by weight based on the total weight of the total surfactant mixture.

The cationic surfactant is perfluoro-octyl sulfonamido, N-hydrogen, N-propylene trimethyl ammonium iodide and is employed in an amount of from 3 to 13 percent by weight, preferably 5 to 12 percent by weight based on the total weight of the total surfactant mixture.

The surfactant mixture is employed in an amount of from 0.35 to 1 gm/100 gms of the coating composition and preferably in an amount of from 0.35 to 0.8 gms/100 gms. The proportion of the various ingredients in any layer of the photographic element formed in accordance with this invention is the same as that present in the coating composition except for the quantity of water employed in the composition that is not present in the photographic layer.

While the coating compositions may be employed with respect to any suitable layer in the photographic element, they are particularly applicable for the formation of overcoat layers, either for the emulsion side or the backside of the photographic element. When employed for the preparation of overcoat layers, the coating compositions and the resulting layers formed therefrom also contain other addenda including polymeric matte beads, lubricating agents and the like. As indicated previously, the formation of repellency spots during the coating process is much more likely to occur when soluble matte beads are incorporated into the photographic layer. These soluble matte beads are removed from the layer during the development of the photographic element. The invention is particularly applicable where soluble matte of a copolymer of methylmethacrylate and methacrylic acid is employed as the matting agent. Whether or not such copolymers are soluble in the processing solutions for developing photographic elements is dependent upon the amount of methacrylic acid employed in the copolymer and the molecular weight of the copolymer formed. This characteristic is known by those skilled in the art.

The surfactants of the mixture act together to provide a number of beneficial properties, including improved layer thickness uniformity and favorable static electric charging behavior of the overcoat surface.

The coating composition may also employ various types of matting agents including the insoluble types as disclosed in *Research Disclosure* publication No. 308 issued December 1989 in Section XVI. Lubricants as disclosed in the same publication in Section XII may also be included.

The photographic composition of the invention may be used to coat any of the following layers of a photographic element: such as, intermediate layers, antihalation layers, filter layers, antistatic layers, protective layers, transparent magnetic recording layers and others as described in *Research Disclosure*, Item 308119, December 1989 [hereinafter referred to as *Research Disclosure*], the disclosure of which is incorporated herein by reference. In a preferred embodiment, the composition of the invention is coated as a protective overcoat of a photographic element.

The material of this invention may comprise a negative-working or positive-working silver halide emulsion layer. Suitable emulsions and their preparation are described in *Research Disclosure* Section I and II and the publications cited therein. Suitable vehicles for the emulsion layers and other layers of elements of this invention are described in *Research Disclosure* Section IX and the publications cited therein.

For color photographic materials, references giving information on couplers and on methods for their dispersion are given in Sections VII and XIV, respectively, of *Research Disclosure*. An account of dye-forming development is given in "Modern Photographic Processing", Vol. 2, Grant Haist, Wiley, N. Y., 1978, Chapter 9.

The photographic materials of this invention, or individual layers thereof, can contain brighteners (see *Research Disclosure* Section V), antifoggants and stabilizers (see *Research disclosure* VI), antistain agents and image dye stabilizers (see *Research Disclosure*, Section VII, paragraph I and J), light absorbing and scattering materials (see *Research Disclosure* Section VIII), hardeners (see *Research Disclosure* Section XI), plasticizers and lubricants (see *Research Disclosure* Section XII), antistatic agents (see *Research Disclosure* Section XIII), matting agents (see *Research Disclosure* Section XVI), and development modifiers (see *Research Disclosure* Section XXI).

The photographic materials can be coated on a variety of supports as described in *Research Disclosure* Section XVII and the reference described therein.

The photographic materials can be exposed to actinic radiation, typically in the visible region of the spectrum, to form a latent image as described in Research Disclosure Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Development is followed by the conventional steps of bleaching, fixing, or bleach-fixing, to remove silver and silver halide, washing and drying.

The invention is further illustrated by the following examples wherein parts and percentages are by weight unless otherwise specified. In the following examples, an overcoat layer, in accordance with this invention, is coated simultaneously with three other layers using conventional multilayer bead coating methods. The general nature of the overcoat layer and the first, second and third layers together with the coverage for each of the layers is set forth below. In Example 1, which follows, for purposes of enabling the evaluation of the spot imperfections in the overcoat layer and second and third layers, the second layer contains carbon particles rather than being a conventional silver halide emulsion layer. The second and first layers indicated below are similar in all respects to gelatin solution concentrations and viscosities of the yellow layers of a color negative film product. The quantity of carbon in the second layer is to provide a transmitted optical density which aids in the visible examination of the thickness uniformity of the layer by transmitted light.

Overcoat layer: gelatin, polymer matte beads, surfactants, and other addenda like dispersed lubricant ( 10–12% solids in water) (wet coverage of 10.6 g/m$^2$)

Third layer: composition of UV absorbing layer* (8.8 g/m$^2$)

Second layer: gelatin ( 10% ), carbon particles, ( 17 g/m$^2$)

First layer: gelatin (5%), (60. g/m$^2$)

*3 weight percent silver halide Lippmann emulsion, 1.6 weight percent Compound A, 1.6 weight percent Compound B and 8 weight percent gelatin.

The four layers are coated simultaneously at a coating speed of 182 meters/minute onto a transparent polyethylene terephthalate film support containing a gelatin subbing layer. The coated polyester support is conveyed through a chilled compartment to chill set the gelatin layers, dried in a warm air drying compartment and wound up in order to permit the careful examination of the coated samples for physical uniformity of the coated layers. Any repellency spots formed in the overcoat layer during the coating process also disturb the adjacent layers, and with carbon in the second layer, the appearance of the spot disturbance resembles the spot nonuniformity which would be observed in the photographic image of the second layer if it were an imaging layer of an actual film product.

EXAMPLE 1

Overcoat layer solutions were prepared from 9 percent lime processed bone gelatin, 1 percent alkali-soluble polymethyl methacrylate co-methacrylic acid matte beads, 0.4 percent silicone oil droplets, 0.06 percent polymethyl methacrylate permanent matte beads, 0.04 gram per 100 grams of solution of cationic fluorosurfactant S4 set forth and the surfactant mixture set forth in Table 1 below. The thus prepared overcoat layer solution is coated simultaneously with the first, second and third layers as described above. The quantity of the particular surfactants employed and the concentration of each in grams per 100 grams of solution together with the repellency spot counts are set forth in Table 1. Medium size repellencies are about 1 mm. Small size repellencies are less than 1 mm but can be seen without magnification. Very small size repellencies can be seen with a 7×magnifier.

The surfactants used are defined as follows:

S1=di- and tri-isopropyl naphthalene sulfonate, sodium salt-Alkanol XC sold by DuPont Co.

S2=di(2-ethyl hexyl) sulfosuccinate, sodium salt-Aerosol OT sold by American Cyanamid S5=di(heptafluorobutyl) sulfosuccinate, sodium salt S3=nonyl phenoxy polyglycidol (8–9) alcohol-Surfactant 10G sold by Olin Corp.

S4=perfluoro-octyl sulfonamido N-hydrogen N-propylene trimethyl ammonium iodide-Fluorad FC-135 sold by 3M Co.

TABLE 1

| | Anionic Surfactants | | | Nonionic Surfactant | Repellencies | | |
|---|---|---|---|---|---|---|---|
| | | | | | Medium Size | Small Size | Very Small |
| | S1 | S2 | S5 | S3 | (1.7 ft$^2$) | (1.7 ft$^2$) | (0.67 ft$^2$) |
| Comparison | 0.29 | 0 | 0 | 0.31 | 1 | 10 | 12 |
| 1-1 | 0.29 | 0.08 | 0 | 0.31 | 0 | 2 | 1 |
| 1-2 | 0.29 | 0.16 | 0 | 0.31 | 0 | 1 | 1 |
| 1-3 | 0.29 | 0 | 0.06 | 0.31 | 0 | 3 | 6 |
| 1-4 | 0.29 | 0 | 0.12 | 0.31 | 0 | 0 | 0 |

Comparisons of repellency spot counts show that the coated samples from overcoat layer solutions numbered 1-1, 1-2, 1-3, and 1-4 containing the mixtures of two anionic surfactants S1+S2 or S1+S5, have fewer repellency spots of all sizes than the coated sample from the comparison overcoat layer solution.

EXAMPLE 2

The procedure of Example 1 is repeated with the exception that 2.6 percent colloidal silica (Ludox AM sold by DuPont Co.) is included. The concentration of the various surfactants employed in grams per 100 grams of solution together with the repellency counts are set forth in Table 2.

The surfactants S1–S5 are as defined above. In Examples 2–5 and 2–6 the surfactant S6-perfluorooctylsulfonate (tetraethyl ammonium salt) sold by Bayer AG under the trade designation Fluortensid FT-248 is used in the amount indicated and in Examples 2–7 the surfactant S7-perfluoro-alkyl carboxylate, ammonium salt where the alkyl carboxylate is predominately hexanoate, sold by 3M Co. under the trade designation Fluorad FC-126, is used in the amount indicated.

TABLE 2

| | Anionic Surfactants | | | Nonionic Surfactant | Repellencies | | |
|---|---|---|---|---|---|---|---|
| | | | | | Medium Size | Small Size | Very Small |
| | S1 | S2 | Other | S3 | (1.7 ft$^2$) | (1.7 ft$^2$) | (0.67 ft$^2$) |
| Comparison | 0.24 | 0 | 0 | 0.26 | 1 | 11 | 8 |
| 2-1 | 0.24 | 0.08 | 0 | 0.26 | 1 | 2 | 1 |
| 2-2 | 0.24 | 0.16 | 0 | 0.26 | 0 | 2 | 2 |
| 2-3 | 0.10 | 0.24 | 0 | 0.26 | 0 | 0 | 0 |
| 2-4 | 0.24 | 0 | S5(0.06) | 0.26 | 0 | 0 | 0 |
| 2-5 | 0.24 | 0 | S6(0.12) | 0.26 | 0 | 0 | 1 |

TABLE 2-continued

| | Anionic Surfactants | | | Nonionic Surfactant | Repellencies Medium Size | Small Size | Very Small |
|---|---|---|---|---|---|---|---|
| | S1 | S2 | Other | S3 | (1.7 ft$^2$) | (1.7 ft$^2$) | (0.67 ft$^2$) |
| 2-6 | 0.24 | 0 | S6(0.20) | 0.26 | 0 | 0 | 2 |
| 2-7 | 0.24 | 0 | S7(0.12) | 0.26 | 0 | 1 | 1 |

Comparisons of repellency spot counts show that the coated samples from overcoat layer solutions numbered 2-1 to 2-7 containing the mixtures of two anionic surfactants have fewer repellency spots of all sizes than the coated sample from the comparison overcoat layer solution.

In Example 3, which follows, an overcoat layer is coated simultaneously with a UV-absorbing layer and two yellow dye-forming layers of color negative film, over previously-coated cyan dye-forming and magenta dye-forming layers and interlayers, using conventional multilayer bead coating methods.

EXAMPLE 3

A cellulose triacetate film support having an antihalation layer on one side and an antistatic layer on the other is coated on the antihalation layer with the following layers in sequence (coverages are in grams per meter squared):

Slow Cyan Dye-Forming Layer

This layer comprises a blend of red-sensitized, cubic, silver bromoiodide emulsion (1.5 mol percent iodide) (0.31 mm grain size) (1.16 g/m$^2$) and red-sensitized, tabular grain, silver bromoiodide emulsion (3 mol percent iodide) (0.75 mm diameter by 0.14 mm thick) (1.31), Compound J (0.965), Compound F (0.011), Compound L (0.65) and gelatin (2.96).

Fast Cyan Dye-Forming Layer

This layer comprises a red-sensitized, tabular grain silver bromoiodide emulsion (6 mol percent iodide) having a diameter of 1.40 mm and a thickness of 0.12 mm (0.807), Compound J (0.102), Compound K (0.065), Compound L (0.102) and gelatin (1.506).

Interlayer

This layer comprises Compound F (0.054), an antifoggant and gelatin (1.291).

Slow Maaenta Dye-Forming Layer

This layer comprises a blend of green-sensitized tabular grain silver bromoiodide emulsion (3 mol percent iodide) (grain diameter 0.55 mm and thickness 0.08 mm) (0.473) and tabular grain silver bromoiodide emulsion (3 mol percent iodide) (grain diameter 0.52 and thickness 0.09 um) (0.495), Compound G (0.161), Compound I (0.108) and gelatin (2.916).

Fast Magenta Dye-Forming Layer

This layer comprises a blend of green-sensitized tabular grain silver bromoiodide emulsion (3 mol percent iodide) (grain diameter 1.05 mm and thickness 0.12 mm) (0.536) and tabular grain silver bromoiodide emulsion (3 mol percent iodide) (grain diameter 0.75 mm and thickness 0.14 mm), Compound G (0.258), Compound H (0.054) and gelatin (1.119).

Interlayer

This layer comprises Carey-Lea Silver (0.43), Compound F (0.054), an antifoggant and gelatin (0.861).

Slow Yellow Dye-Forming Layer

This layer comprises a blend of blue-sensitized tabular grain silver bromoiodide emulsions (3 mol percent iodide) (grain diameter 0.57 mm and thickness 0.12 mm) (0.274) and blue-sensitive silver bromoiodide emulsion (0.3 mol percent iodide) (grain diameter 0.52 mm and thickness 0.09 mm) (0.118), Compound C (1.022), Compound D (0.168) and gelatin (1.732).

Fast Yellow Dye-Forming Layer

This layer comprises a blue-sensitized tabular grain silver bromoiodide emulsion (3 mol percent iodide) (grain diameter 1.10 mm and thickness 0.12 mm) (0.43), Compound C (0.161), Compound D (0.054), Compound E (0.003) and gelatin (0.791).

UV Absorbing Layer

This layer comprises silver halide Lippmann emulsion (0.215), Compound A (0.108), Compound B (0.106) and gelatin (0.538).

Overcoat

This layer comprises the alkali soluble matte particles, (0.038) and gelatin (0.888) and surfactant mixture of Example 1 (1-1 of Table 1)

The thus prepared photographic film exhibits few repellency spots.

The structures of the above-designated Compounds A through L are as follows:

A:

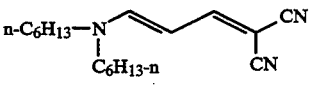

B:

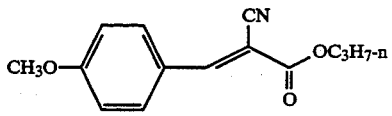

C:

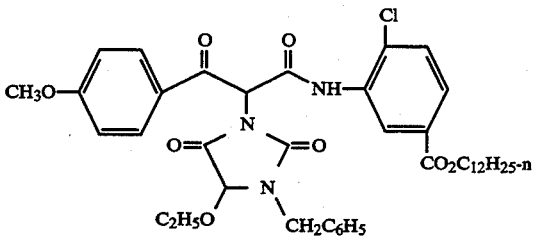

-continued
D:
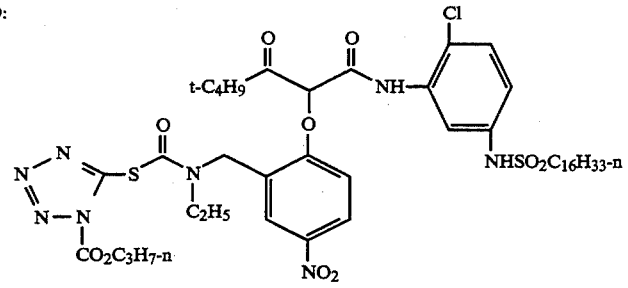
E:
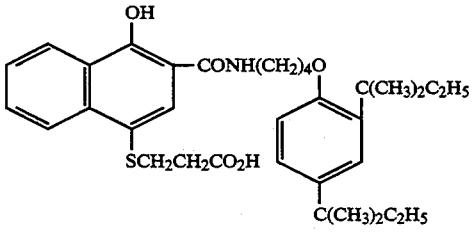
F:
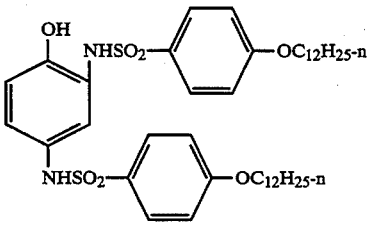
G:
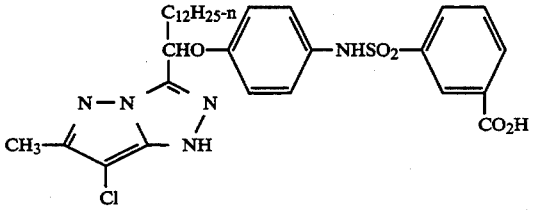
H:
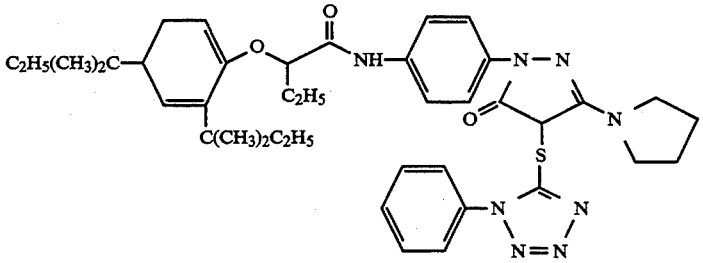
I:
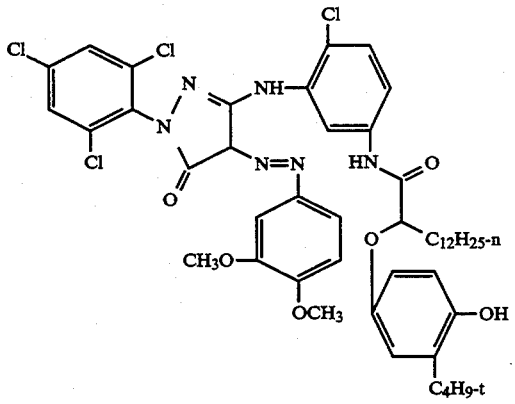
J:
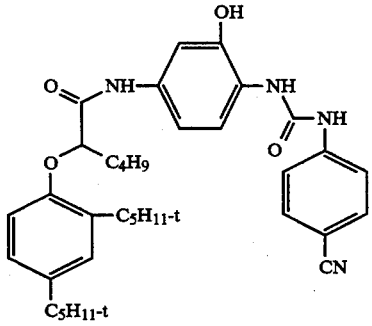

K:

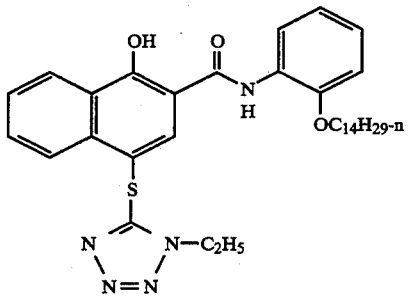

-continued

L:

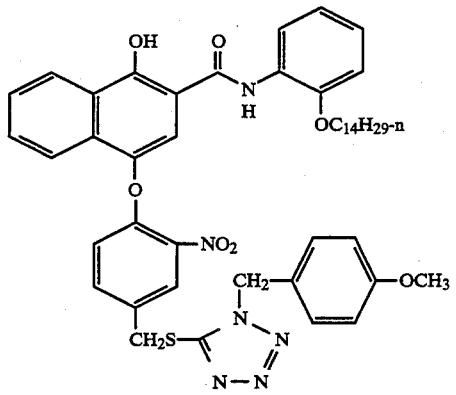

What is claimed is:

1. A photographic element comprising a support, at least one light-sensitive silver halide layer and at least one layer containing gelatin and a surfactant mixture comprising from 20 to 60 percent by weight of a mixture of anionic surfactants, from 30 to 75 percent by weight of a nonionic surfactant and from 3 to 13 percent by weight of a cationic surfactant based on the total weight of surfactant mixture; the mixture of anionic surfactants comprising from 30 to 85 percent by weight of di- and tri-isopropyl naphthalene sulfonate, sodium salts and from 15 to 70 percent by weight of a dioctyl sulfosuccinate, sodium salt; a di-fluoroalkyl sulfosuccinate, sodium salt where alkyl has from 4 to 6 carbon atoms; perfluoro-octyl sulfonate(tetraethyl ammonium salt) or a perfluoro-alkyl carboxylate ammonium salt where alkyl is a mixture of alkyl radicals having from 5 to 8 carbon atoms with hexyl being the major component of the mixture, based on the total weight of the anionic surfactants; the nonionic surfactant being a nonyl phenoxy poly(glycidyl alcohol and the cationic surfactant being perfluoro-octyl sulfonamide, N-hydrogen, N-propylene trimethylammonium iodide.

2. The photographic element of claim 1 wherein the di- and tri-isopropyl naphthalenesulfonate, sodium salt is present in the amount of 40 to 80 percent by weight based on the total weight of the anionic surfactants.

3. The photographic element of claim 1 wherein the octylsulfosuccinate sodium salt di-(2-ethylhexyl)sulfosuccinate, sodium salt.

4. The photographic element of claim 1 wherein the fluoroalkyl groups of the di-fluoroalkyl sufosuccinate, sodium salt are 2,2,3,3,4,4,4 heptafluorobutyl.

5. The photographic element of claim 1 wherein matte beads are present in a layer containing gelatin.

6. The photographic element of claim 5 wherein the matte beads are alkali soluble.

7. The photographic element of claim 6 wherein the matte beads are poly(methylmethacrylate-comethacrylic acid).

8. The photographic element of claim 1 wherein the nonyl phenoxy poly(glycidyl) alcohol is present in the amount of 40 to 60 percent by weight.

9. The photographic element of claim 1 wherein the nonyl phenoxy poly(glycidyl) alcohol has the formula:

$$C_9H_{19}—C_6H_4—O—(CH_2\underset{\underset{OH}{|}}{C}HCH_2O)_n—H$$

where n represents values of from 6 to 12 with a mean value of 8 to 9.

10. The photographic element of claim 1 wherein the perfluoro-octyl sulfonamido, N-hydrogen, N-propylenetrimethylammonium iodide is present in an amount of from 5 to 12 weight percent.

* * * * *